US007958853B2

(12) United States Patent
Ruchti

(10) Patent No.: US 7,958,853 B2
(45) Date of Patent: Jun. 14, 2011

(54) STEAM GENERATOR

(75) Inventor: Christoph Ruchti, Uster (CH)

(73) Assignee: ALSTOM Technology Ltd., Baden (CH)

( * ) Notice: Subject to any disclaimer, the term of this patent is extended or adjusted under 35 U.S.C. 154(b) by 1036 days.

(21) Appl. No.: 11/689,007

(22) Filed: Mar. 21, 2007

(65) Prior Publication Data

US 2007/0227469 A1 Oct. 4, 2007

(30) Foreign Application Priority Data

Mar. 31, 2006 (DE) ..... 10 2006 015 094

(51) Int. Cl.
*F28D 7/08* (2006.01)
*F22B 1/02* (2006.01)

(52) U.S. Cl. ..... 122/32; 122/406.4; 122/425; 165/159

(58) Field of Classification Search ..... 122/7 R, 122/1 B, 32, 36, 51, 55, 259, 262, 363, 422, 122/425, 444, 406.4, 451 S, 74; 165/157, 165/159, 160
See application file for complete search history.

(56) References Cited

U.S. PATENT DOCUMENTS

| | | | | |
|---|---|---|---|---|
| 1,817,948 | A * | 8/1931 | Smith | 165/82 |
| 1,869,973 | A | 8/1932 | Lucke | |
| 2,920,874 | A * | 1/1960 | Gardner | 165/140 |
| 3,356,135 | A | 12/1967 | Sayre | |
| 3,863,608 | A * | 2/1975 | Yasugahira et al. | 122/483 |
| 4,206,802 | A * | 6/1980 | Reed et al. | 165/113 |
| 4,289,093 | A * | 9/1981 | Coggins et al. | 122/197 |
| 4,620,588 | A * | 11/1986 | Pfouts et al. | 165/285 |
| 6,237,545 | B1 * | 5/2001 | Barnett et al. | 122/235.23 |
| 6,276,442 | B1 * | 8/2001 | Rasmussen | 165/110 |
| 2008/0282997 | A1 * | 11/2008 | Gayheart et al. | 122/441 |

FOREIGN PATENT DOCUMENTS

| | | |
|---|---|---|
| DE | 962169 | 4/1957 |
| DE | 1601776 | 2/1971 |
| DE | 4038813 | 6/1992 |
| DE | 69703334 T2 | 5/2001 |

* cited by examiner

*Primary Examiner* — Gregory A Wilson

(74) *Attorney, Agent, or Firm* — Cermak Nakajima LLP; Adam J. Cermak

(57) ABSTRACT

A steam generator has a pressure casing formed in the shape of a drum. The longitudinal axis of this pressure casing is oriented horizontally or largely horizontally. A hollow tube (1) is formed in such a way that at least two hollow tube sections (1') are provided, preferably a plurality of hollow tube sections which extend predominantly parallel to each other, and which are arranged in stack-form vertically or vertically offset above each other, and which in each case are interconnected in pairs at an end section, wherein this hollow tube is located in the vertical direction above the feed section (8).

16 Claims, 3 Drawing Sheets

STEAM GENERATOR

This application claims priority under 35 U.S.C. §119 to German application number 10 2006 015 094.5, filed 31 Mar. 2006, the entirety of which is incorporated by reference herein.

BACKGROUND

1. Field of the Invention

The invention relates to a steam generator with a pressure-tight pressure casing which encloses a volume and in which extends at least one hollow tube which is hermetically sealed in relation to the volume, which hollow tube is connected in each case to a feed section and a discharge section which project through the pressure casing in a fluidtight manner, wherein at least one opening for feed of a heat flow into the volume, and also at least one opening for outlet of the heat flow, which engages in thermal interaction with the at least one hollow tube, is provided in the pressure casing.

2. Brief Description of the Related Art

Steam generators of the aforementioned generic type serve preferably for thermal coupling in a combined gas-steam turbine arrangement in which the hot air which issues from the compressor of the gas turbine plant is fed to a steam generator system where it is cooled so much so that it can be fed back into the gas turbine for cooling purposes. The steam generator draws the water from the economizers of the waste heat boiler and feeds the steam which is produced into the superheater of the waste heat boiler, from where it is directed through the steam turbine for expansion.

For steam production, especially for the purpose of power production, steam generator systems which are as flexible as possible are used, of which the concept of so-called once-through coolers (OTC) is subsequently elaborated upon. The so-called OTC systems have cylindrically formed pressure casings of high construction, the standing height of which clearly projects beyond the gas turbine. Inside the cylindrically formed pressure casing, which is formed with pressure-tight effect, such OTC coolers have water-carrying pipes which are formed helically around the longitudinal axis of the cylinder and which are spatially fixed by means of so-called perforated support plates, with only a small mutual radial spacing. For illustration of such a cooler arrangement, refer to the representation in FIG. 2, in which a tube bundle arrangement is apparent, which can be introduced inside a pressure-tight, cylindrically formed pressure casing, which is not shown. The hollow tube arrangement, which is shown in the representation in FIG. 2, is horizontally arranged for assembly purposes, and in the case of normal use would be erected vertically upright inside the pressure casing, which is not shown. In this connection, the section which is shown on the right in the pictorial representation corresponds to the upper section. The representation in FIG. 2 is basically the helical multiple arrangement of individual hollow tubes 1 around a common cylinder axis Z, which tubes are all wound radially around the cylinder axis Z in the form which is represented, with a high, mutual packing density. Radial support plates 2, which are arranged in sectors in a distributed manner around the cylinder axis Z, and which provide a plurality of perforations which are defined on the outside diameter of the individual hollow tubes and through which the hollow tubes 1 are to be threaded for assembly purposes, serve for spatial fixing and mutual spacing of the individual hollow tubes 1. It requires no further explanation that the assembly alone of the hollow tube arrangement which is shown in FIG. 2 is extremely time-consuming and, therefore, costly.

For steam production, water is fed through the hollow tubes 1 in such a way that the hollow tubes 1 are flow-washed from the left-hand side to the right-hand side of the hollow tube arrangement in the figure, while the hollow tube arrangement is flow-washed by hot air of a gas turbine arrangement, which is not additionally shown, in the reverse direction, i.e., from the right-hand side to the left-hand side in the pictorial representation. This flow configuration corresponds to the reverse flow principle and allows the water which is fed into the hollow tubes in the bottom, i.e., on the left-hand side, of the hollow tube arrangement in the figure, to be effectively heated until it evaporates inside the individual hollow tubes 1 in the right-hand section of the hollow tube arrangement. All the hollow tubes, in the upper section of the steam generator, i.e., in the right-hand section in FIG. 2, lead into the so-called steam collector D, from which the steam is user-specifically discharged. In the case of a combined gas turbine plant, the steam generator arrangement shown in FIG. 2 serves to drive a steam turbine and for the corresponding conversion into electrical energy.

In addition to the aforementioned high costs for production of such a steam generator, the exceedingly large overall height of the steam generator, which is to be erected vertically, also encounters constructional and system technical problems, particularly that it is not possible for space reasons to position such steam generators spatially close to those points of a gas turbine plant at which hot air can be tapped for steam production. The consequence is a comparatively large distance between such a steam generator system and the gas turbine plant, as a result of which connecting pipes of long construction are necessary in order to bring the hot air flows to the corresponding feed points of the steam generator. This, however, inevitably leads both to thermoenergetic losses and to pressure losses along the respective connecting pipes, as a result of which the efficiency for steam production is ultimately significantly impaired.

SUMMARY

One aspect of the present invention includes a steam generator with a pressure-tight pressure casing which encloses a volume and in which extends at least one hollow tube which is hermetically sealed in relation to the volume, which hollow tube is connected in each case to a feed and a discharge section which project through the pressure casing in a fluidtight manner, wherein at least one opening for feed of a heat flow into the volume, and also at least one opening for outlet of the heat flow, which engages in thermal interaction with the at least one hollow pipe, is provided in the pressure casing, in such a way that on one hand the production expenditure is to be significantly reduced compared with the steam generator principle which is explained at the beginning, so that the production costs can be reduced. Moreover, on the other hand it is necessary to create a constructional form of a steam generator which is as compact and low in construction as possible so that the steam generator can be placed as close as possible to a gas turbine plant, as far as possible beneath the operating platform. In this way, it can be possible to form the pipes, which are required for the exchange of heat flow between gas turbine plant and steam generator, as short as possible, in order to generate the lowest possible resulting pressure losses. Finally, it is possible to improve the efficiency of a whole combined power plant.

In another aspect of the present invention, a steam generator is formed by the pressure casing being formed in the shape of a drum, and has a longitudinal axis and also a diameter which measures perpendicularly to the longitudinal axis.

Unlike the hitherto customary positioning of such well known drum-shaped pressure casings, the steam generator concept, according to this aspect, provides that the pressure casing is placed in a horizontal position so that the longitudinal axis of the pressure casing is oriented horizontally, or largely horizontally, and, consequently, the pressure casing has a longitudinal extent which is greater than its diameter. The horizontal arrangement of the pressure casing, according to this aspect, brings about in an advantageous way an appreciable reduction of the overall height of the steam generator, as a result of which new possibilities of the arrangement of the pressure casing relative to a gas turbine plant are opened up.

At least one pipe, or generally at least one hollow tube, is provided inside the pressure casing and is formed in such a way that at least two pipe or hollow tube sections are provided, preferably a plurality of pipe or hollow tube sections, which extend predominantly parallel to each other, which are arranged in stack form vertically or vertically offset above each other, and in each case are interconnected in pairs on an end section. It is preferred, in the provision of the at least one hollow tube inside the volume of the pressure casing, to provide the pressure casing with a plurality of tightly packed hollow tubes, with as much space filling effect as possible, through which the evaporable fluid, preferably water, which is required for steam production, is directed, and which, as is described later, is brought into thermal contact with a heat flow, preferably with the hot air which issues from a compressor unit of a gas turbine plant, for the warming up and heating inside the pressure casing. Each individual hollow tube, which has hollow tube sections which are guided vertically above each other and parallel to each other in each case, and which are interconnected similar to a meander form, has a vertically lower feed point through which, for example, the water is introduced into the hollow tube, which water rises vertically upwards along the meander-form or serpentine course, as the case may be, in order to leave the hollow tube through an outlet opening. The feed opening and also the outlet opening are connected in each case to a feed section or discharge section, as the case may be, which projects through the pressure casing in a fluidtight manner so that it is ensured that the fluid which is to be evaporated can be fed in liquid form from outside the pressure casing into the at least one hollow tube, and that after corresponding warming up and heating of the fluid, the steam which is formed along the hollow tube can be discharged from the pressure casing for further technical use. In this connection, the discharge section is arranged in the vertical direction above the feed section of the at least one hollow tube. Furthermore, in the vertically upper section of the pressure casing at least one opening is provided for feed of the heat flow, for example in the form of hot air which is extractable directly from the air flow at the outlet of the compressor of a gas turbine plant. The passage of heat flow through the pressure casing takes place in such a way that the heat flow flows over the hollow tube sections of the at least one hollow tube transversely to its extent which is directed along the longitudinal axis, with a flow direction which is oriented from the top vertically downwards. Therefore, it is ensured that the heat flow direction takes place in the opposite direction to the flow direction of the evaporable fluid inside the at least one hollow tube. Thus, the concept of the upwards evaporation of the evaporable fluid inside the respective hollow tubes, in counterflow with regard to the heat flow which is introduced into the pressure casing, stays similar to that steam generator concept which is applied in hitherto customary vertically standing steam generators.

A special aspect of the steam generator which is formed according to the present invention provides a high as possible packing density of the hollow tube sections which are guided parallel to each other in each case, and which are allocated in each case to a plurality of individual hollow tubes, wherein the entirety of the individual vertical hollow tube stacks, which are arranged spatially as close as possible to each other, fill out volume sections of the pressure casing which are as large as possible. The heat flow inlet into the pressure casing is carried out for a heat transfer which is as effective as possible, on the part of the heat flow, to the hollow tubes and, ultimately, to the evaporable fluid which is guided inside the hollow tubes, in such a way that the heat flow passes once through the hollow tube arrangement transversely to the extent of the individual hollow tube sections, for which reason the steam generator concept according to the solution also corresponds to the OTC concept which was described at the beginning, i.e., the heat flow passes once through the hollow tube arrangement and transfers heat to the hollow tube arrangement during this once-through passage. In order to improve the thermal interaction between heat flow and hollow tube arrangement, at least one hollow tube is designed in an advantageous way with finned effect, i.e., is provided with a contoured tube surface form in order to increase the hollow tube surface on one hand, and on the other hand to improve the heat transfer between heat flow and hollow tube.

A simple exemplary embodiment of the pressure casing provides for at least one opening for outlet of the heat flow, which is brought into thermal contact with the at least one hollow tube, being provided in the lower section of the pressure casing therefore being provided on the side of the pressure casing which lies diametrically opposite the inlet opening for the heat flow, so that the heat flow passes unidirectionally, so to speak, through the volume of the pressure casing without an internal deflection inside the pressure casing. However, this assumes that an adequate installation depth is provided beneath the horizontally disposed pressure casing in order to correspondingly transfer or discharge, as the case may be, the heat flow which issues from the pressure casing.

On the other hand, a further exemplary embodiment provides for the location of the openings both for the inlet and also for the outlet of the respective heat flow into or out of the pressure casing, as the case may be, on the upper section of the pressure casing in each case so that all feed pipes or discharge pipes, as the case may be, for the transporting of the heat flow, can be provided on the more easily accessible upper side of the otherwise horizontal pressure casing. Additionally necessary installation depths below the pressure casing can be avoided in this way. In such an embodiment, however, it is necessary by suitable measures to deflect the heat flow, which is oriented vertically downwards, in the opposite flow direction after passage through the hollow tube arrangement, and, in doing so, to see to it that the flow section which passes through the hollow tube arrangement is not irritated by the outlet flow which is oriented through the deflected outlet opening. For the constructional development of such an embodiment, a later exemplary embodiment is referred to in detail.

In addition to the low type of construction of the steam generator according to the present invention, which is advantageously achievable by the horizontal positioning of the drum-shaped pressure casing, the steam generator concept according to the solution, moreover, enables an appreciably simplified assembly, especially a simplified assembly of the hollow tube arrangement which can be produced in a far shorter assembly time and by managing with far fewer technically exacting assembly steps. The hollow tube arrangement, which is to be introduced inside the pressure casing, and which is preferably assembled from a plurality of individual tubes, can finally be assembled according to a simple mechanical assembly technique. If it is assumed, for example, that each individual hollow tube has a plurality of hollow tube sections which lie above each other in meander form and which are interconnected in a parallel guided manner and in their turn correspond to a vertical stack, and if it is further assumed that the hollow tube has a round tube cross section, then it is possible, by placing next to each other similarly formed hollow tubes, to join the individual hollow tubes to each other with a maximum packing density by a vertically slightly offset arrangement. The vertical stack height of the individual hollow tube sections per hollow tube, in the same way as the width defined by a correspondingly selected number of tube sections which are placed next to each other, depends upon the spatial holding capacity of the pressure casing. As the further embodiments, with reference to corresponding exemplary embodiments, will show, it is possible by simple production steps to mount the hollow tube arrangement, which is assembled from a plurality of individual hollow tubes, outside the pressure casing and then to insert the hollow tube arrangement as a prefabricated part component into the pressure casing. A fixing of the prefabricated hollow tube arrangement inside the pressure casing is preferably carried out by fixing rails which are provided in a fixed manner on the inner wall of the pressure casing and upon which individual hollow tube sections are able to be partially supported. Finally, it merely requires the fluidtight connection of the respective feed and discharge sections to the individual hollow tubes which ensure a fluidtight connection of the hollow tubes.

BRIEF DESCRIPTION OF THE DRAWINGS

The invention is exemplarily described below, based on exemplary embodiments with reference to the drawing, without limitation of the general inventive idea. In the drawing.

DETAILED DESCRIPTION OF EXEMPLARY EMBODIMENTS

Figure 1:
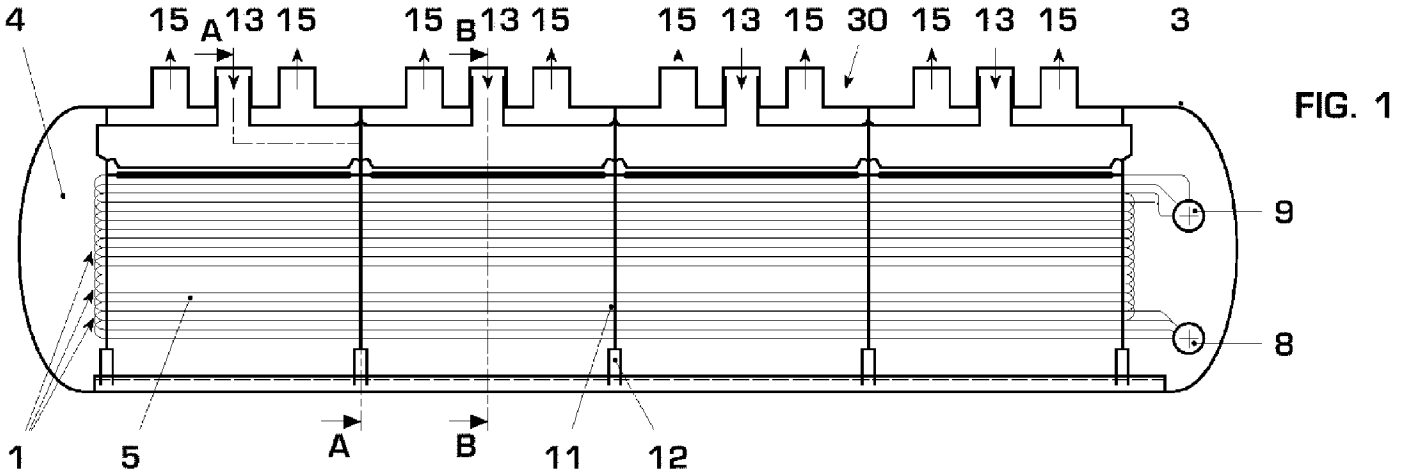
FIG. 1 shows a schematized longitudinal cross section through a boiler casing which is formed according to the solution, FIGS. 1A, B show cross-sectional views through a boiler casing with hollow tube arrangement.
Figure 1B:
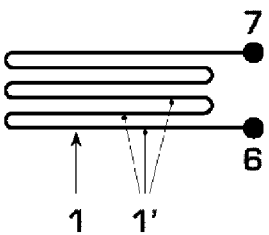
Figure 1B:
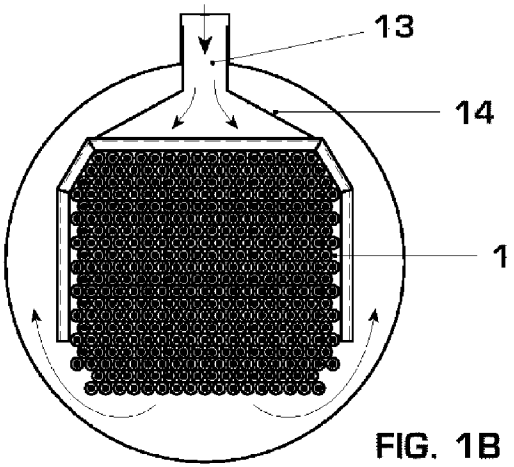
Figure 1A:
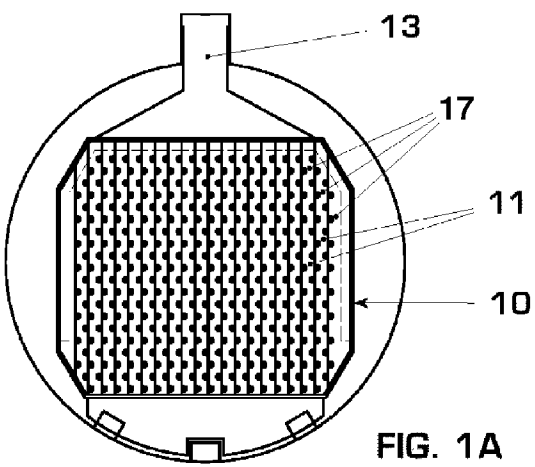

FIG. 1 shows a longitudinal cross section through a cylindrically formed pressure casing 3, which, in the exemplary embodiment which is shown, has a circular cross section; see also, concerning this, the split drawings according to FIGS. 1A and 1B, which in each case show cross-sectional views along the sectional planes A and B which are drawn in FIG. 1. The pressure casing 3 optionally has a round, oval, or polygonal cross section. The pressure casing 3, which is formed in the fashion of a cylinder, encloses an inner volume 4 in which is introduced a hollow tube arrangement 5 which includes a plurality of individual hollow tubes 1. The hollow tube arrangement 5, which includes a plurality of individual hollow tubes 1, provides for individual hollow tubes 1 which are arranged next to each other, which, in their turn, include a plurality of hollow tube sections 1' which are arranged vertically above each other, as this is apparent in a very schematized manner from the sub-figure according to FIG. 1. In this way, a hollow tube 1 is assembled from a plurality of individual hollow tube sections 1' which are interconnected in meander-form or serpentine-form, as the case may be, and which extend parallel to each other, which hollow tube sections, in their turn, are arranged vertically above each other in stack form. Each individual hollow tube 1 is supplied with an evaporable fluid, preferably with water, through a vertically lower feed opening 6, which fluid, after passage through all the hollow tube sections 1', emerges from the hollow tube 1 through a vertically upper outlet opening 7.

Inside the pressure casing 3, therefore, there is a plurality of hollow tubes 1 which in each case are arranged next to each other with offset effect, as previously described, wherein the feed openings 6 of the individual hollow tubes 1 lead into a common feed section 8 through which all the hollow tubes 1 are supplied with water. Likewise, all the outlet openings 7 of the hollow tubes 1 lead into a common discharge section 9 which is located vertically above the feed section 8, as shown in FIG. 1, and, similar to the feed section 8, passes through the pressure casing 3 to the outside with fluidtight effect. For illustration of the hollow tube arrangement 5 which is produced by assembling a plurality of individual hollow tubes 1, for example refer to the cross-sectional view according to FIG. 1B, from which it is apparent that directly adjacent hollow tubes 1 are arranged with offset effect in relation to each other, so that a high packing density between the individual hollow tubes 1 can be created. A support structure 10, which includes a plurality of holding devices 11 which are formed in a disk-like or rib-like fashion, serves for the mutual spatial fixing of the individual hollow tubes 1 and also for easy assembly of the hollow tube arrangement 5. Each individual holding device 11 has recesses 12 which are adapted to the external contour of the respective hollow tube sections, so that the individual hollow tubes 1 can be installed in the offset arrangement which is predetermined by the recesses 12. The assembly takes place in each case in such a way that hollow tubes 1 which are to be arranged next to each other are held in each case sandwich-like between two adjacent holding devices 11. As a result, the assembly is carried out in layers outside the pressure casing 3. The support structure 10, which includes the individual holding devices 11, is provided along the longitudinal sectioned view, which is shown in FIG. 1, at five points in each case which are arranged in a distributed manner, and fixes the whole hollow tube arrangement 5 centrally inside the volume of the pressure casing 3. The support structures 10 are connected to the pressure casing 3 by corresponding fasteners 17.

For feed of a heat flow, preferably feed of hot gases of a gas turbine plant, four openings 13 for feed of the heat flow into the volume 4 of the pressure casing 3 are provided in the upper section 30 of the pressure casing along the longitudinal extent of the pressure casing 3. As is to be gathered from the cross-sectional drawings according to FIGS. 1A and B, a device 14 for conducting the heat flow is connected downstream of the feed openings 13 for further guidance of the heat flow, through which the heat flow passes once, vertically from the top downwards, in a directed manner through the spatial area of the hollow tube arrangement. On account of the cylindrically formed, therefore round internal contour of the pressure casing 3, the heat flow, which is directed vertically downwards, is diverted onto the inner walls of the pressure casing, as is schematically shown in FIG. 1B, and is guided vertically upwards again close to the walls of the pressure casing, where the heat flow emerges from the pressure casing 3 through corresponding openings 15.

The structural shape of a steam generator, which is shown in FIGS. 1 to 1B, is an especially preferred embodiment which enables a heat flow inlet or heat flow outlet, as the case may be, on the upper side of the pressure casing 3 in each case, so that a compact installation shape for the steam generator is created. The steam generator according to the solution typically has a pressure casing longitudinal extent of 5 to 10 meters, and a pressure casing diameter of about 2 to 3 meters. The advantage of a horizontal arrangement is self-evident in consideration of the geometric dimensions, particularly in that the overall height, which is predetermined by the diameter, does not exceed typical overall dimensions of gas turbine plants and so enables a compact and safety regulation-compliant close location to the gas turbine plant.

Figure 2:
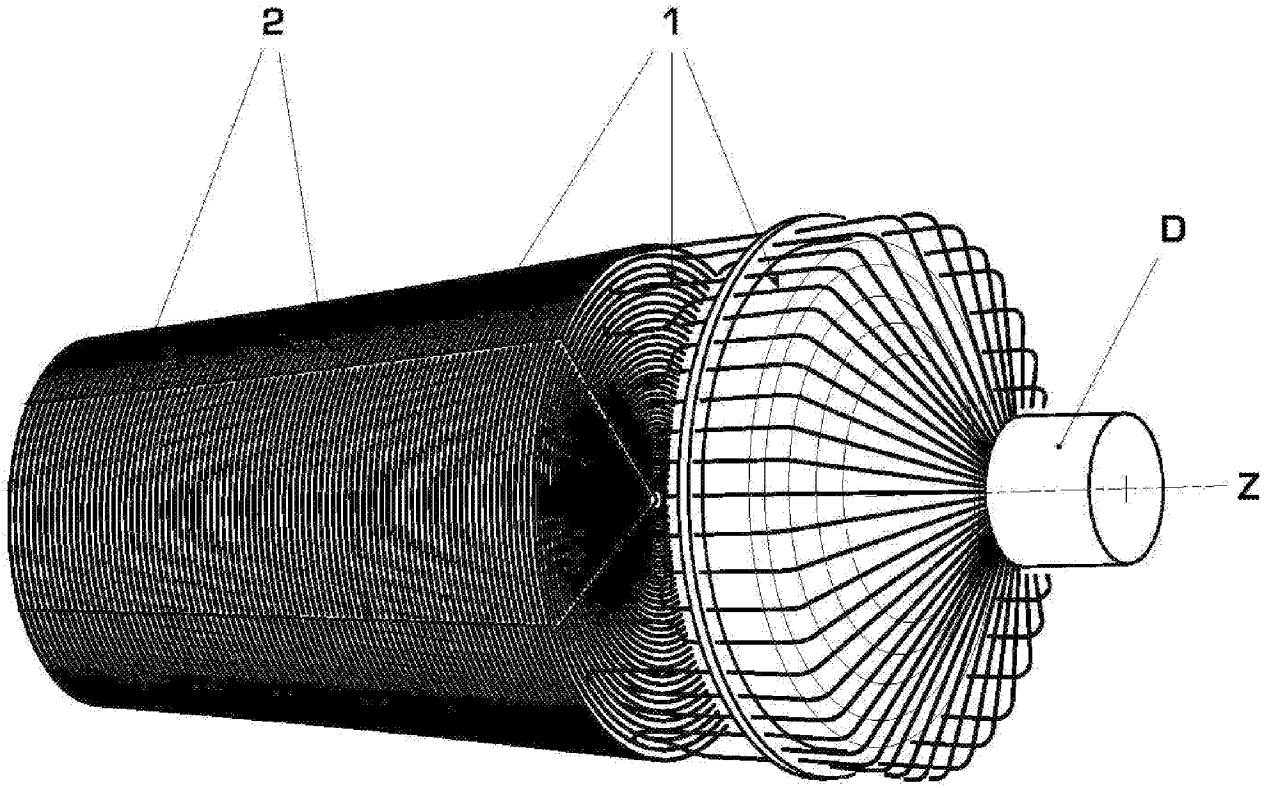
Fig. 2 (Prior Art)
FIG. 2 shows a view of the hollow tube arrangement of an OTC cooling system known per se.

Reference to the description according to the known hollow tube arrangement, as it is shown in the representation in FIG. 2, was already made in the introductory part of the description.

Figure 3:
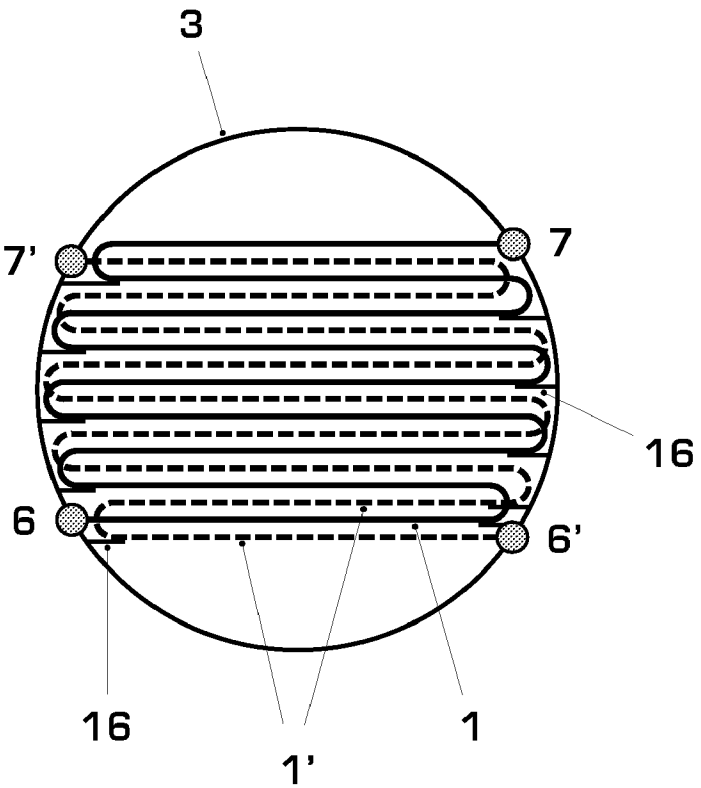
FIG. 3 shows a schematized cross-sectional view of an alternative exemplary embodiment.

In FIG. 3, a schematized cross section through a pressure casing 3 is shown, in which, unlike the embodiment according to FIG. 1 in which the hollow tube sections 1' of the individual hollow tube 1 extend parallel to the longitudinal axis, the hollow tube sections 1' extend transversely to the longitudinal axis, i.e., perpendicularly, but lying horizontally. It is thus assumed that a front first hollow tube 1, as indicated by the dashed lines, is supplied with fluid through a lower feed opening 6 in the cross-sectional view according to FIG. 3, which fluid emerges at the vertically upper outlet opening 7 after passage along the hollow tube sections 1' which are interconnected in meander form and vertically above each other. A further hollow tube (see dashed lines), which is arranged behind it in the longitudinal direction, however, is supplied with water through the feed opening 6', which water emerges through the outlet opening 7' after corresponding passage through all the hollow tube sections 1'. The whole hollow tube arrangement, therefore, can be assembled by a plurality of individual hollow tubes which are arranged consecutively in the longitudinal direction and in each case arranged with offset effect in relation to each other, wherein the feeding and discharging for the evaporable fluid in each case is to be undertaken in the way which is specified in the cross-sectional view according to FIG. 3.

Figure 4:
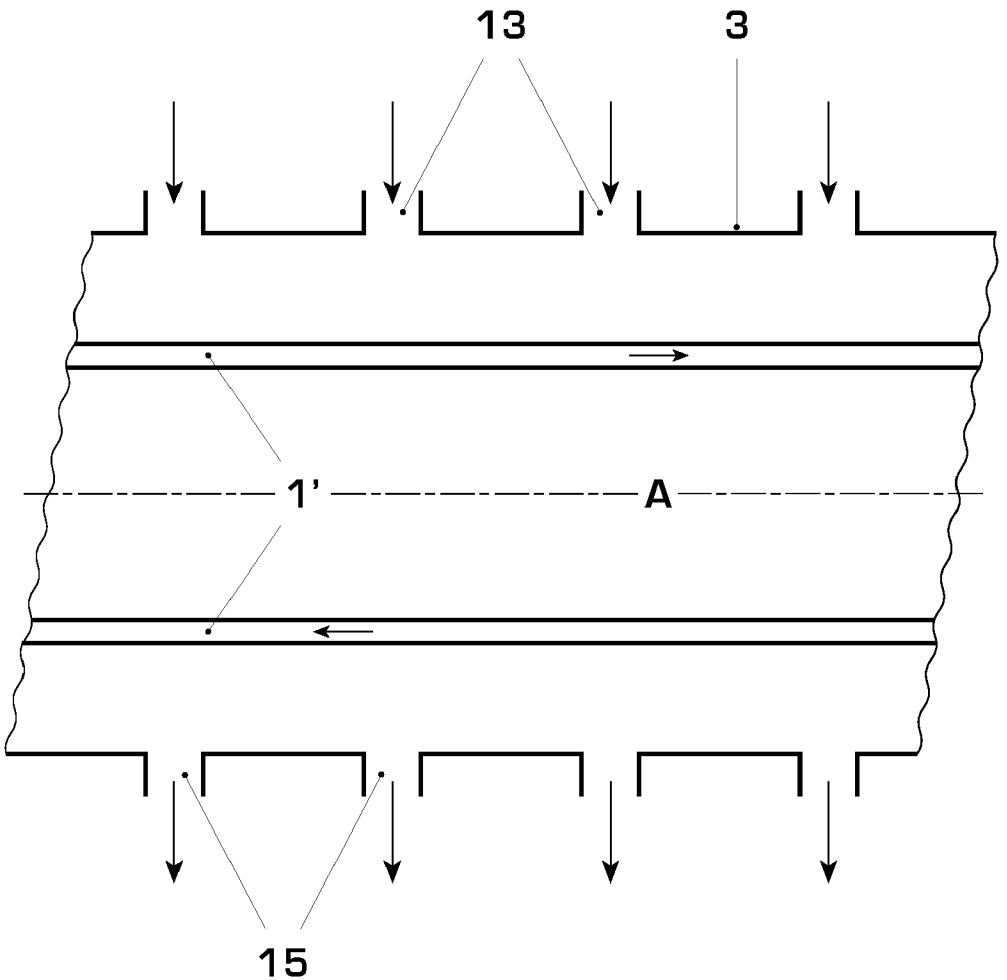
FIG. 4 shows a schematized longitudinal partial cross section through a boiler casing.

Finally, an alternative location of openings 13 for the feed of a heat flow into the pressure casing 3 and also openings 15 for the outlet of a heat flow from the pressure casing 3 is apparent from the schematized partial longitudinal sectional view through a pressure casing 3 according to FIG. 4. Unlike the embodiment according to FIG. 1, the respective openings 13, 15 are located diametrically opposite relative to the longitudinal axis A, so that the heat flow inside the pressure casing 3 is not deflected but passes unidirectionally through the volume 4 of the pressure casing 3. Finally, it is shown in a schematized manner that the hollow tube arrangement 1, which is characterized by two hollow tube sections 1', which in each case extend parallel to the longitudinal axis A, is subjected to throughflow of an evaporable fluid, wherein the flow direction of the fluid through the hollow tubes 1 takes place from the bottom upwards, i.e., opposite to the vertically downwards oriented flow direction of the heat flow.

So-called support rails 16, which are connected laterally to the inner wall of the pressure casing 3, and which are shown in a schematized manner in the cross-sectional view according to FIG. 3, serve for the location and fastening of the individual hollow tubes 1 inside the pressure casing 3.

List of designations

| | |
|---|---|
| 1 | Hollow tube |
| 1' | Hollow tube section |
| 2 | Support plate |
| 3 | Pressure casing |
| 4 | Volume |

-continued

| | |
|---|---|
| 5 | Hollow tube arrangement |
| 6 | Feed opening |
| 7 | Outlet opening |
| 8 | Feed section |
| 9 | Discharge section |
| 10 | Support structure |
| 11 | Holding device |
| 12 | Fastening structure |
| 13 | Opening for feed of the heat flow |
| 14 | Device for conducting heat flow |
| 15 | Opening for outlet of the heat flow |
| 16 | Support rails |
| 17 | Fasteners |
| 30 | Pressure casing section |
| D | Steam collector |
| Z | Cylinder axis |

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A steam generator comprising:

a pressure-tight pressure casing enclosing a volume;

at least one hollow tube extending in the casing volume, the at least one hollow tube being hermetically sealed from the casing volume;

a feed section and a discharge section which fluidtightly project through the pressure casing, the at least one hollow tube fluidly connected to the feed section and to the discharge section;

wherein the pressure casing includes at least one opening for feed of heat flow into the volume, and at least one opening for outlet of heat flow, configured and arranged so that heat thermally interacts with the at least one hollow tube;

wherein the pressure casing is drum shaped and has a longitudinal axis and a diameter perpendicular to the pressure casing longitudinal axis;

wherein the pressure casing longitudinal axis is oriented horizontally, and the pressure casing along the longitudinal axis is larger than along the pressure casing diameter;

wherein the at least one hollow tube is configured and arranged to provide at least two hollow tube sections which extend parallel to each other and which are stacked vertically or vertically offset above each other, and are each interconnected in pairs at an end section in a serpentine form;

wherein the discharge section is arranged in the vertical direction above the feed section; and wherein the at least one opening for feed of heat flow is located in a vertically upper section of the pressure casing, such that heat flow inside the pressure casing occurs over the hollow tube sections transversely to their longitudinal extent, with a flow direction which is oriented from the top vertically downwards.

2. The steam generator as claimed in claim 1, wherein the pressure casing has a round, oval, or polygonal cross section.

3. The steam generator as claimed in claim 1, wherein the at least one opening for feed of heat flow into the volume and the at least one opening for outlet of heat flow are configured and arranged so that the heat flow flows unidirectionally over the hollow tube sections in the way of a once-through flow-over.

4. The steam generator as claimed in claim 1, wherein the plurality of hollow tube sections are horizontally arranged inside the pressure casing.

5. The steam generator as claimed in claim 1, wherein the plurality of hollow tube sections are oriented parallel or perpendicularly to the pressure casing longitudinal axis.

6. The steam generator as claimed in claim 1, wherein the at least one hollow tubes comprises a plurality of individual hollow tubes, the individual hollow tubes each arranged next to each other in the hollow tube sections and forming a hollow tube arrangement, hollow tube sections which lie directly next to each other being arranged vertically offset from each other.

7. The steam generator as claimed in claim 6, further comprising:

at least one support structure;

wherein the hollow tubes of the hollow tube arrangement are fixed by the at least one support structure; and wherein the at least one support structure encompasses all the hollow tubes along a plane which orthogonally intersects the longitudinal axis.

8. The steam generator as claimed in claim 7, wherein the at least one support structure comprises a plurality of individual holding devices with recesses which are adapted to an external contour of the hollow tube sections of the individual hollow tubes; and wherein the plurality of individual holding devices with the hollow tube sections each positioned in the recesses, are configured and arranged to be stacked together.

9. The steam generator as claimed in claim 7, further comprising:

a plurality of support structures positioned along the hollow tube arrangement, the plurality of support structures spaced apart along the longitudinal axis.

10. The steam generator as claimed in claim 1, wherein the pressure casing comprises an inner wall, and further comprising:

support rails connecting the at least one hollow tube to the pressure casing inner wall.

11. A method of using a steam generator as a cooler unit of a gas turbine plant, the plant having a gas turbine, with a steam-operated unit, the method comprising:

providing a steam generator as claimed in claim 1 fluidly between the gas turbine plant and the steam operated unit;

cooling at least partially expanded air of the gas turbine with the steam generator; and conducting steam from the steam generator to the steam-operated unit.

12. The method as claimed in claim 11, operating the steam generator as a once-through cooler, including flowing the at least partially expanded air against the at least one hollow tube, and guiding an evaporable fluid through the at least one hollow tube.

13. The method as claimed in claim 12, wherein guiding an evaporable fluid comprises guiding water.

14. The method as claimed in claim 11, further comprising:

positioning the pressure casing directly next to the gas turbine with the pressure casing longitudinal axis oriented horizontally.

15. A steam generator comprising:

a pressure-tight pressure casing enclosing a volume;

at least one hollow tube extending in the casing volume, the at least one hollow tube being hermetically sealed from the casing volume;

a feed section and a discharge section which fluidtightly project through the pressure casing, the at least one hollow tube fluidly connected to the feed section and to the discharge section;

wherein the pressure casing includes at least one opening for feed of heat flow into the volume, and at least one opening for outlet of heat flow, configured and arranged so that heat thermally interacts with the at least one hollow tube;

wherein the pressure casing is drum shaped and has a longitudinal axis and a diameter perpendicular to the pressure casing longitudinal axis;

wherein the pressure casing longitudinal axis is oriented horizontally, and the pressure casing along the longitudinal axis is larger than along the pressure casing diameter;

wherein the at least one hollow tube is configured and arranged to provide at least two hollow tube sections which extend parallel to each other and which are stacked vertically or vertically offset above each other, and are each interconnected in pairs at an end section;

wherein the discharge section is arranged in the vertical direction above the feed section;

wherein the at least one opening for feed of heat flow is located in a vertically upper section of the pressure casing, such that heat flow inside the pressure casing occurs over the hollow tube sections transversely to their longitudinal extent, with a flow direction which is oriented from the top vertically downwards; and wherein the at least one opening for outlet of heat flow is located in a lower section of the pressure casing so that heat flow flows unidirectionally through the pressure casing volume and perpendicularly to the pressure casing longitudinal axis.

16. A steam generator comprising:

a pressure-tight pressure casing enclosing a volume;

at least one hollow tube extending in the casing volume, the at least one hollow tube being hermetically sealed from the casing volume;

a feed section and a discharge section which fluidtightly project through the pressure casing, the at least one hollow tube fluidly connected to the feed section and to the discharge section;

wherein the pressure casing includes at least one opening for feed of heat flow into the volume, and at least one opening for outlet of heat flow, configured and arranged so that heat thermally interacts with the at least one hollow tube;

wherein the pressure casing is drum shaped and has a longitudinal axis and a diameter perpendicular to the pressure casing longitudinal axis;

wherein the pressure casing longitudinal axis is oriented horizontally, and the pressure casing along the longitudinal axis is larger than along the pressure casing diameter;

wherein the at least one hollow tube is configured and arranged to provide at least two hollow tube sections which extend parallel to each other and which are stacked vertically or vertically offset above each other, and are each interconnected in pairs at an end section;

wherein the discharge section is arranged in the vertical direction above the feed section;

wherein the at least one opening for feed of heat flow is located in a vertically upper section of the pressure casing, such that heat flow inside the pressure casing occurs over the hollow tube sections transversely to their longitudinal extent, with a flow direction which is oriented from the top vertically downwards;

wherein the at least one opening for outlet of heat flow is located in an upper section of the pressure casing:

means for conducting the heat flow inside the pressure casing which heat flow conducting means downwardly guides the heat flow which enters through the feed opening, such that the heat flow thermally engages the at least one hollow tube; and wherein the heat flow conducting means is also for deflecting the heat flow inside the pressure casing so that the heat flow flows upwards close to the inner wall of the pressure casing, is separated from the at least one hollow tube by the heat flow conducting means, and emerges at the top from the pressure casing through the at least one opening.

* * * * *